United States Patent [19]

Milleson

[11] Patent Number: 4,977,727

[45] Date of Patent: Dec. 18, 1990

[54] APPARATUS FOR FILLING CASES WITH A PLURALITY OF ARTICLES ARRANGED IN A PREDETERMINED PATTERN

[75] Inventor: Joseph P. Milleson, Ft. Atkinson, Wis.

[73] Assignee: APV Crepaco, Inc., Lake Mills, Wis.

[21] Appl. No.: 352,745

[22] Filed: May 16, 1989

[51] Int. Cl.[5] ..... B65B 5/08; B65B 35/36

[52] U.S. Cl. ..... 53/543; 53/247; 53/251

[58] Field of Search ..... 53/543, 537, 538, 531, 53/247, 251, 250, 249, 235, 448, 443

[56] References Cited

U.S. PATENT DOCUMENTS

| | | | |
|---|---|---|---|
| 2,630,951 | 3/1953 | Slightam | 53/543 X |
| 4,251,979 | 2/1981 | Horigome et al. | 53/543 |
| 4,402,173 | 9/1983 | Thierion | 53/247 X |
| 4,731,977 | 3/1988 | Maekawa | 53/247 |
| 4,843,797 | 7/1989 | Butterly, Jr. et al. | 53/543 X |

*Primary Examiner*—James F. Coan

*Attorney, Agent, or Firm*—Neuman, Williams, Anderson & Olson

[57] ABSTRACT

An apparatus is provided for filling cases with a plurality of articles while arranged in a predetermined pattern. The apparatus includes a pair of staging areas disposed on opposite sides of a first station. Each staging area accommodates a predetermined number of articles. Disposed in vertical alignment with and beneath the first station is a second station wherein a predetermined number of cases are disposed. Adjustably mounted above each staging area is a carrier having a plurality of article gripper members. When the predetermined number of articles are accommodated at the staging areas, the gripper members engage the articles and raise same to preliminary stations above the staging areas. While at each preliminary station the gripped articles are arranged in a row and a selected article is segregated from the row and moved relative thereto in a direction towards the other row of gripped articles. Once the selected articles have been segregated, the raised articles and the respective carriers are moved to the first station wherein the articles assume a predetermined pattern. The articles, while in the predetermined pattern are lowered into one or more cases disposed at the second station. The carriers then return to their respective staging areas and the procedure is repeated until the cases are filled whereupon the filled cases are conveyed away from the apparatus.

15 Claims, 10 Drawing Sheets

APPARATUS FOR FILLING CASES WITH A PLURALITY OF ARTICLES ARRANGED IN A PREDETERMINED PATTERN

BACKGROUND OF THE INVENTION

Filling of conventional square or rectangular, milk cases, crates or corrugated boxes with a plurality of articles having frusto-conical or cylindrical configurations has heretofore been a time-consuming, awkward, labor intensive operation. In commercial packing facilities such as dairy plants, oftentimes only a part of the packing operation for such articles is normally performed by mechanical equipment. Such equipment in the past has either been of complex, costly construction; prone to malfunction; incapable of handling a variety of articles; slow in operation and thus, difficult to coordinate with other high-speed equipment commonly utilized in the packing line; or frequently damaged the articles being cased thereby rendering same unmarketable.

SUMMARY OF THE INVENTION

Thus, an improved case-filling apparatus has been provided which avoids all of the aforenoted shortcomings besetting prior apparatus of this general type.

The improved apparatus is of compact design and may be readily installed in commercial packing lines utilizing conventional high-speed equipment.

The improved apparatus may be readily serviced, maintained and adjusted to accommodate articles and cases of various sizes and shapes.

The improved apparatus is fully automatic and utilizes the sources of electrical and pneumatic power normally available in such commercial packing facilities.

The improved apparatus is provided with numerous safety features for effective personnel and product protection.

The operation of the improved apparatus is computer programmed and may be readily varied to suit a particular packing situation.

In accordance with one embodiment of the invention, a case-filling apparatus is provided which comprises a supporting frame having a pair of relatively spaced article-staging areas disposed proximate a first station located at one level. A second station is provided within the frame which is disposed at a second level beneath the first station and is in vertical alignment therewith. A first conveyor means is provided for conveying a plurality of individual articles to the staging areas whereupon the conveyed articles are arranged in a row at each staging area. The article rows are in substantially parallel relation and disposed on opposite sides of the first station. Adjacent each staging area is a set of gripper members. The number of gripper members in a set corresponds to a predetermined number of the articles in the row at the adjacent staging area. Each set of gripper members is mounted to sequentially operate to engage the predetermined number of articles in the adjacent row and raise the row of engaged articles to a predetermined elevation above the staging area. A selected article in the raised row is then segregated from the row and moved laterally by a gripper member a predetermined distance towards the other row of articles. Subsequent to the segregation, the sets of gripper members and the articles engaged thereby move towards one another to the first station whereupon the engaged articles are arranged in a predetermined pattern and in substantial alignment with the case or cases disposed at the second station. The sets of gripper members are lowered as a unit from the first station until the engaged articles are positioned within the aligned case or cases whereupon the gripper members release the articles and return to the first station. Once the gripper members have returned to the first station, each set of gripper members moves independently away from the other and returns to a position adjacent to and above the corresponding staging area. The operation of the gripper members is initiated only after the staging areas are filled with the required number of articles and the desired number of cases are positioned at the second station.

DESCRIPTION

For a more complete understanding of the invention reference is made to the drawings wherein.

Figure 14:
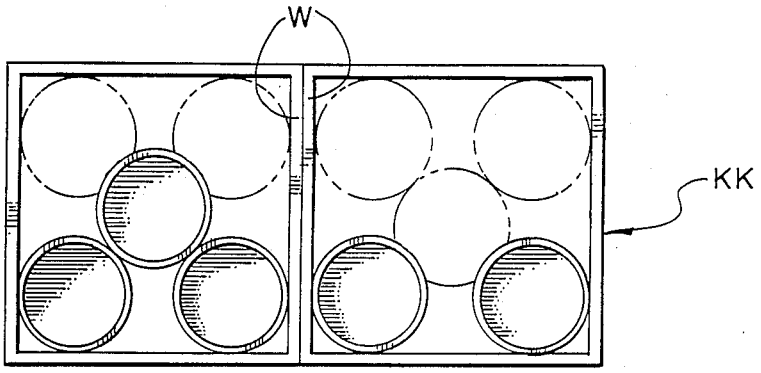
FIG. 14 is a diagrammatic top plan view of a pair of cases disposed at the second station and showing in full lines the predetermined pattern of articles, including the segregated article, deposited therein by the set of gripper members illustrated in FIG. 12, the articles deposited by the other set of gripper members are shown in phantom lines.
Figure 15:
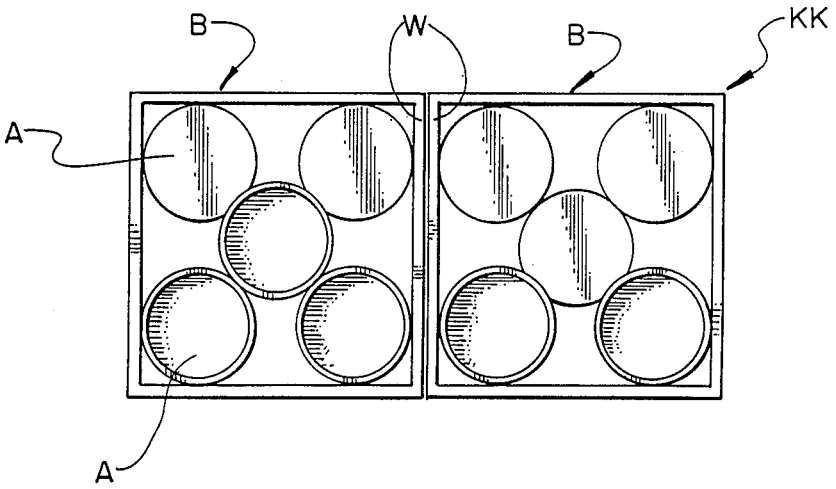

FIG. 15 is similar to FIG. 14 but showing both cases fully loaded; the articles depicted by double lines being those previously engaged by one set of gripper members and those shown in single lines being previously engaged by the other set of gripper members; the articles shown in double lines are slightly raised relative to the other articles so as to facilitate simultaneous entry of all the articles into the cases without being obstructed by the upper edges of the case walls.

Figure 16:
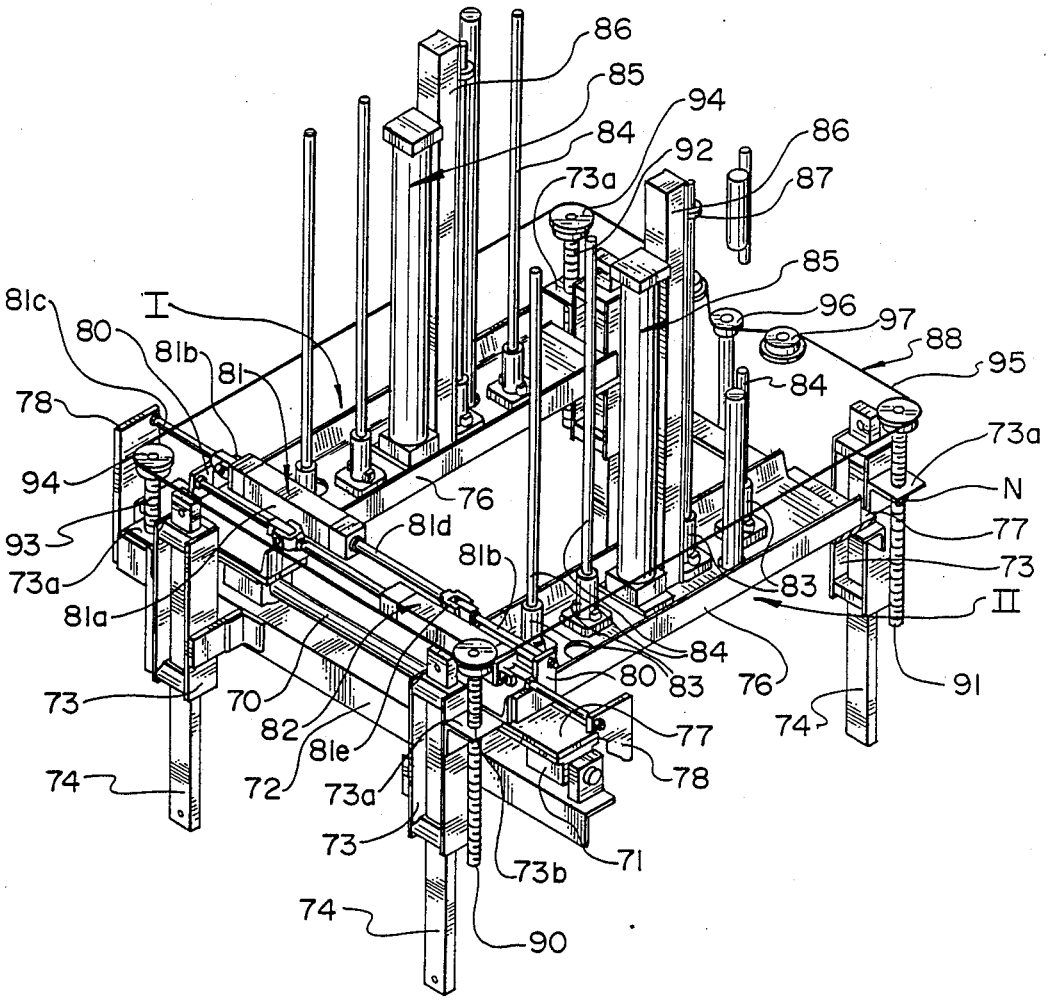

FIG. 16 is a fragmentary top perspective view of the upper portion per se of the apparatus.

Figure 1:
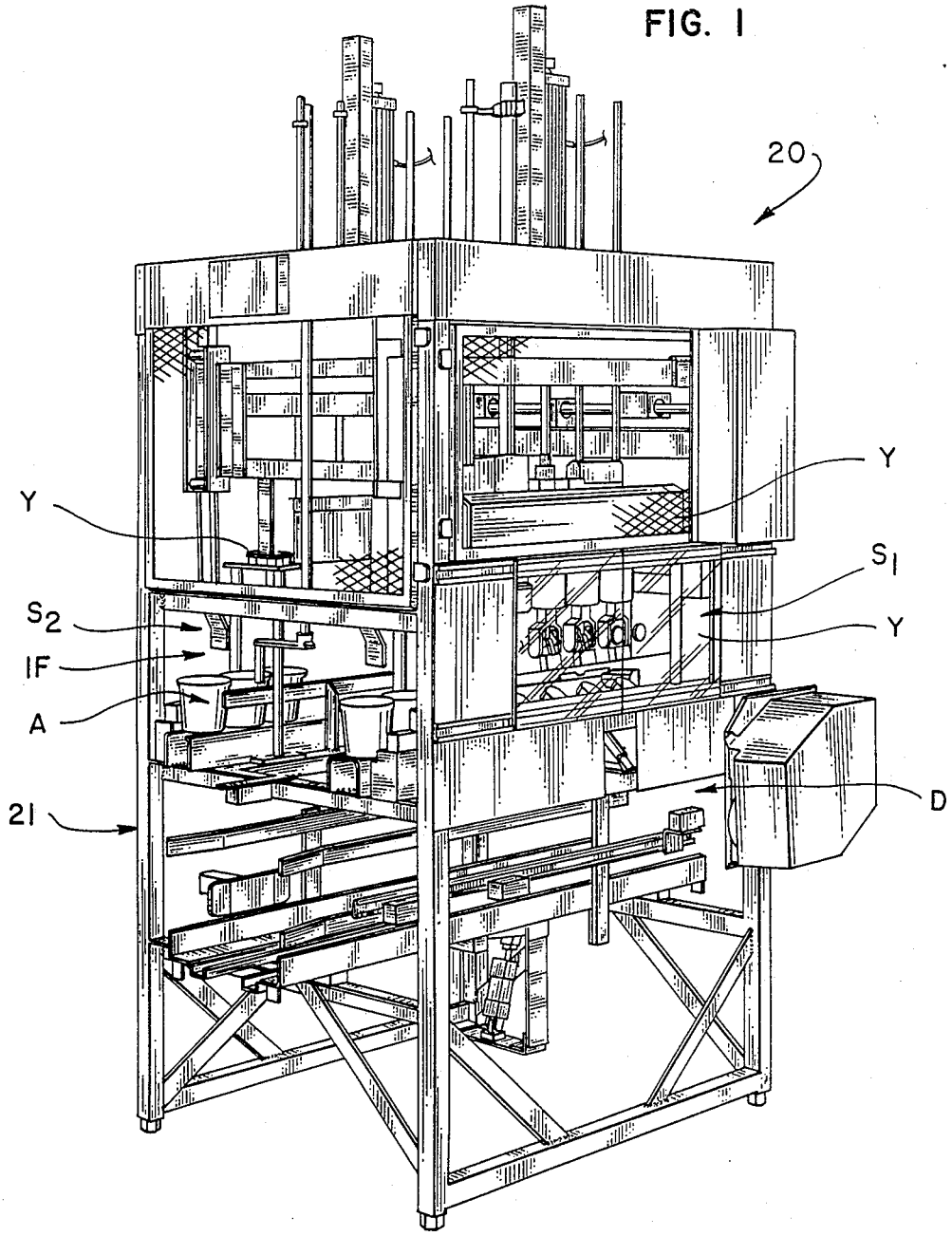
FIG. 1 is a fragmentary, perspective, right side view of one embodiment of the improved apparatus and showing the infeed end thereof.
Figure 2:
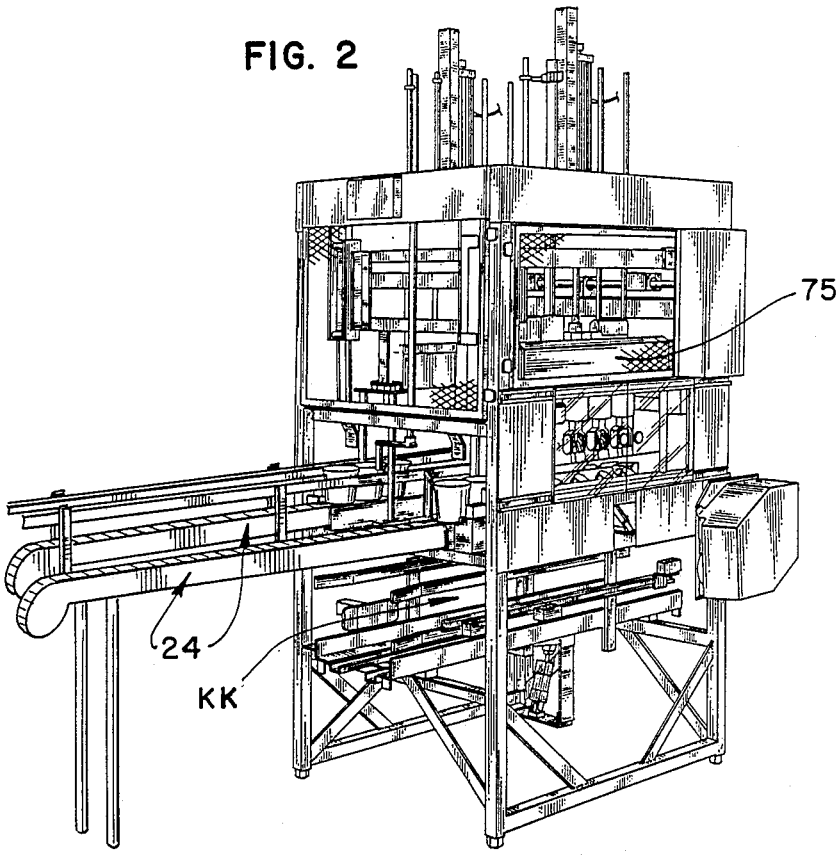
FIG. 2 is similar to FIG. 1 but showing various safety panels removed and the conveyor sections associated with the staging areas.

Referring now to the drawings and more particularly to FIGS. 1 and 2, one embodiment of the improved casing apparatus 20, sometimes referred to as a caser, is shown which is suitable for use in a commercial packing line such as might be found in a dairy plant. The apparatus 20, as hereinafter described, is suitable for packing a plurality of articles, such as frusto-conical containers A (e.g. ten in number), simultaneously into two conventional square-shaped milk cases, or crates B arranged in abutting side by side relation, see FIG. 15. The containers may be of a type normally utilized in packing cottage cheese, yogurt, sour cream, etc. It is to be understood that the invention, herein described and claimed, is not intended to be limited for use exclusively with such containers and cases.

Figure 1A:
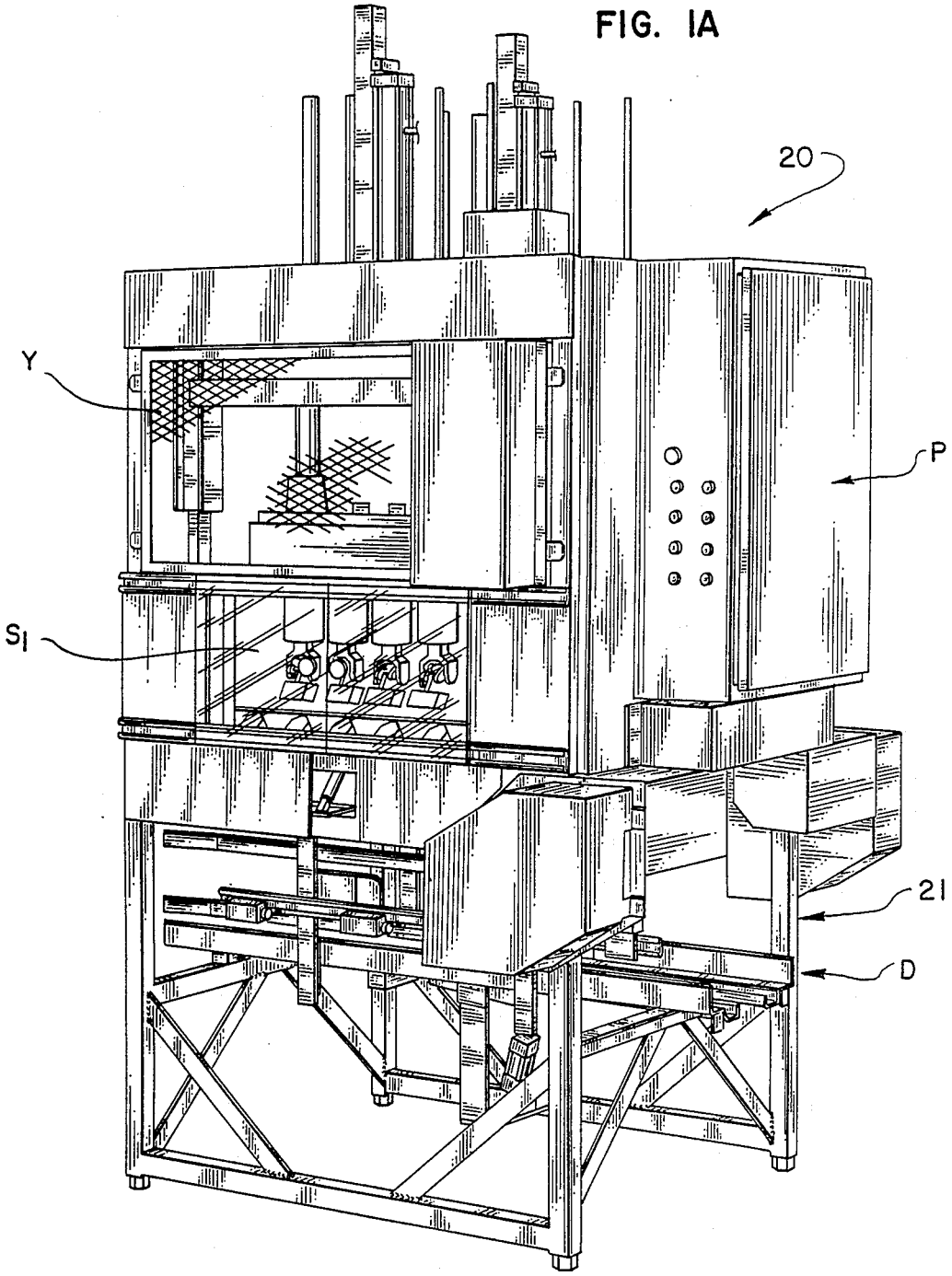
FIG. 1A is similar to FIG. 1 but showing the discharge end of the improved apparatus.
Figure 3:
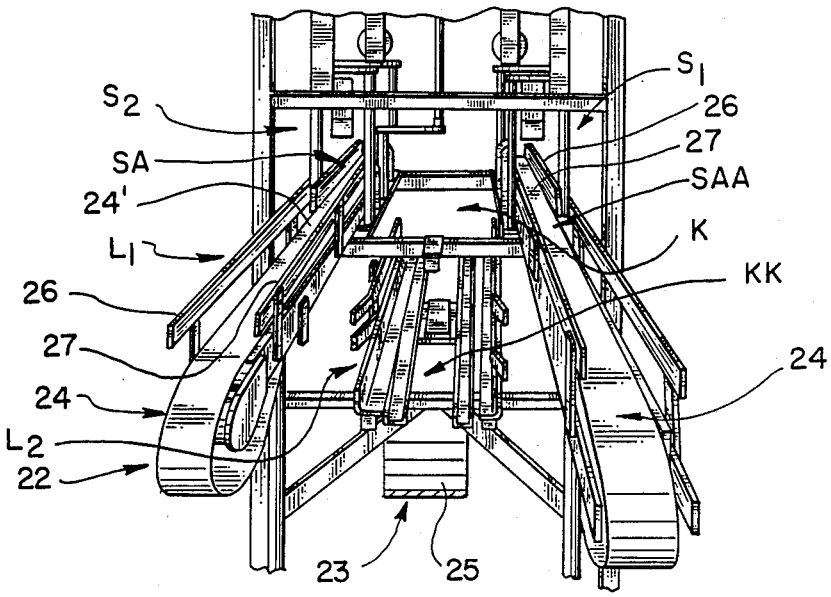
FIG. 3 is a fragmentary perspective view of the infeed end of the apparatus of FIG. 2 with safety panels removed.
Figure 6:
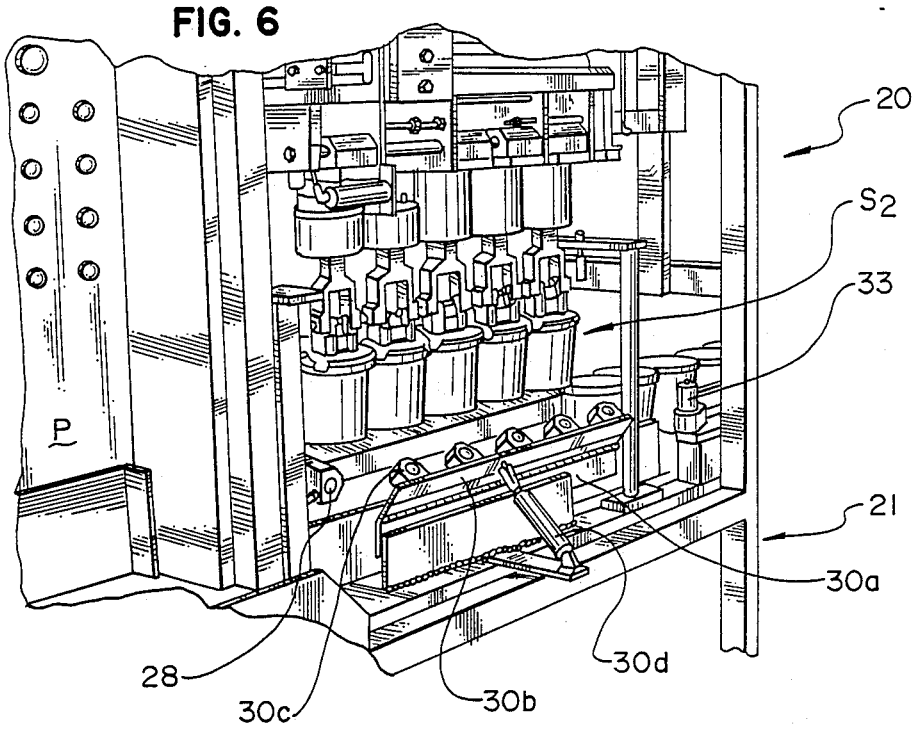
FIG. 6 is similar to FIG. 4 but showing one row of articles raised by the gripper members to an elevated preliminary station above the staging area; the gauge unit in an inoperative mode; and additional articles beginning to assemble at the staging area.

The apparatus 20 includes an upright frame 21 having an infeed side or end IF, see FIG. 1, a discharge side or end D, see FIG. 1A and right and left sides $S_1$ and $S_2$ respectively, see FIGS. 1 and 6. As seen in FIG. 3, the infeed side IF accommodates two infeed lines 22 and 23 which are disposed at different levels $L_1$ and $L_2$. Infeed line 22 is at the upper level $L_1$ and includes a pair of conveyor units 24 which are power actuated to feed two lines of containers onto two staging areas SA and SAA, the latter being in opposed relation and disposed on opposite sides of a first station K provided within the interior of the frame, see FIG. 3.

Infeed line 23 is disposed at the lower level $L_2$ and includes a conveyor unit 25 which in the illustrated embodiment feeds a pair of conventional square-shaped milk cases or crates B, sometimes referred to as receptacles, to a second station KK within the frame interior. The first and second stations are in vertical alignment.

Figure 4:
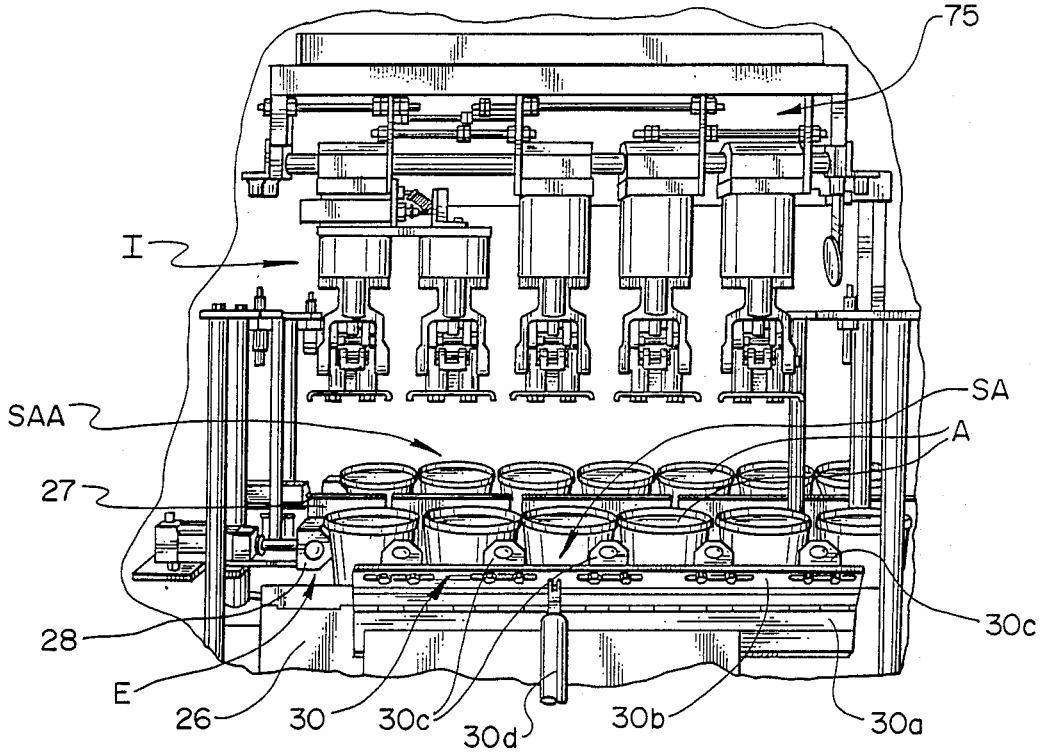
FIG. 4 is an enlarged, fragmentary, perspective left side view of the apparatus of FIG. 1 showing various safety panels removed and individual articles being assembled on the staging areas, the gripper members in a raised position, and a gauge unit in an inoperative mode.

Each staging area SA or SAA is of like configuration and includes a pair of elongated rails 26, 27 arranged in spaced, parallel relation and having a section 24′ of the conveyor unit 24 extending therebetween. The ends of the rails adjacent the frame infeed side IF may be flared outwardly so as to facilitate entry of the containers A between the rails. Disposed at the opposite ends of the rails 26, 27 and in alignment with the conveyor unit section 24′ is a stop block 28 which is adapted to be selectively moved between extended and retracted positions E and R, see FIGS. 4 and 5, respectively.

Adjustably mounted on the outwardly disposed rail 26 is an elongated gauge unit 30 which includes a lower section 30*a* which is affixed to the outer surface of rail 26 and an upper section 30*b* which is substantially coextensive with section 30*a* and is hingedly connected thereto for movement between operative and inoperative modes. Uniformly spaced along the upper edge of section 30*b* and extending angularly therefrom are a plurality of individual fingers 30*c*, see FIG. 4. The hinged movement of the upper section 30*b* relative to the fixed lower section 30*a* is controlled by a pneumatic piston-cylinder assembly 30*d*. When the upper section 30*b* is in the inoperative mode, see FIG. 4, the fingers 30*c* are positioned out of the path of travel of the containers A being assembled on the adjacent staging area SA or SAA. When in the operative mode, see FIG. 5, which occurs after the required number of containers have been assembled on the adjacent staging area, the upper section 30*b* is hinged inwardly towards the other rail 27 an amount which is sufficient to cause the fingers 30*c* thereof to be located between and properly space the adjoining containers forming the row at the adjacent staging area. The distal end of each finger is tapered so as to facilitate positioning of the finger between adjacent containers in the row.

Figure 5:
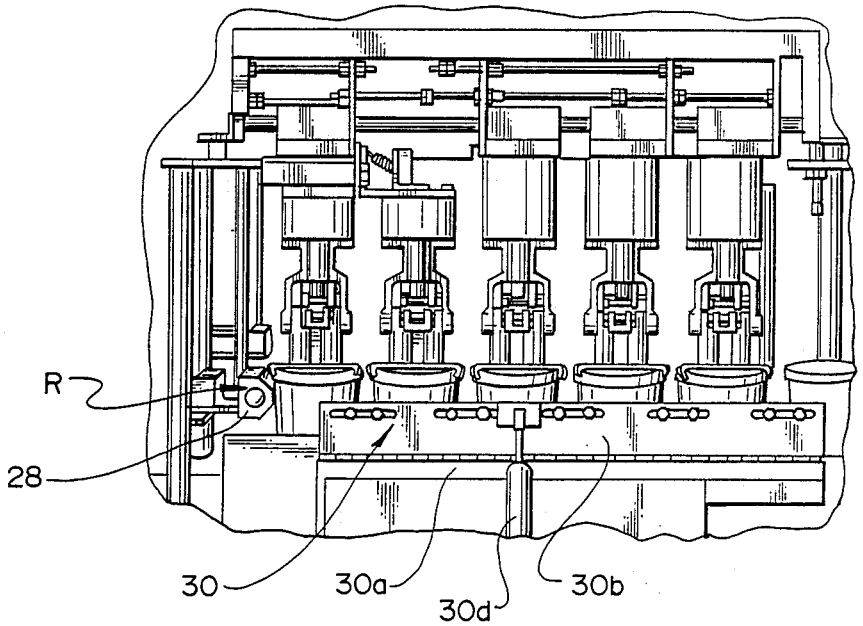
FIG. 5 is similar to FIG. 4 but showing the gauge unit in an operative mode and the gripper members in a lowered article-gripping position.

Simultaneous with the movement of the upper section 30*b* to the operative position, the stop block 28 assumes its retracted position R, see FIG. 5, thereby allowing a predetermined number of containers comprising the row to be spread apart a given amount permitting a small amount of shifting to occur between the containers so that they will be in proper alignment with a set I or II of gripper members 32A–E to be described more fully hereinafter, see FIG. 12. One set of gripper members is provided for each staging area SA or SAA.

Just prior to, or simultaneous with, the stop block 28 being moved to a retracted position, a gate piece 33, pivotally mounted on the frame 21 at the infeed side IF thereof, is actuated from an inoperative mode, see FIG. 6, to an operative mode, wherein it blocks further assembly of the containers from the conveyor unit 24 onto the corresponding staging area SA or SAA. The timing sequence of the operations of the stop block 28, gauge member 30 and the gate piece 33 is controlled through a computer modem incorporated in a control panel P mounted on the frame 21 adjacent the discharge side D thereof, see FIG. 1A.

Figure 9:
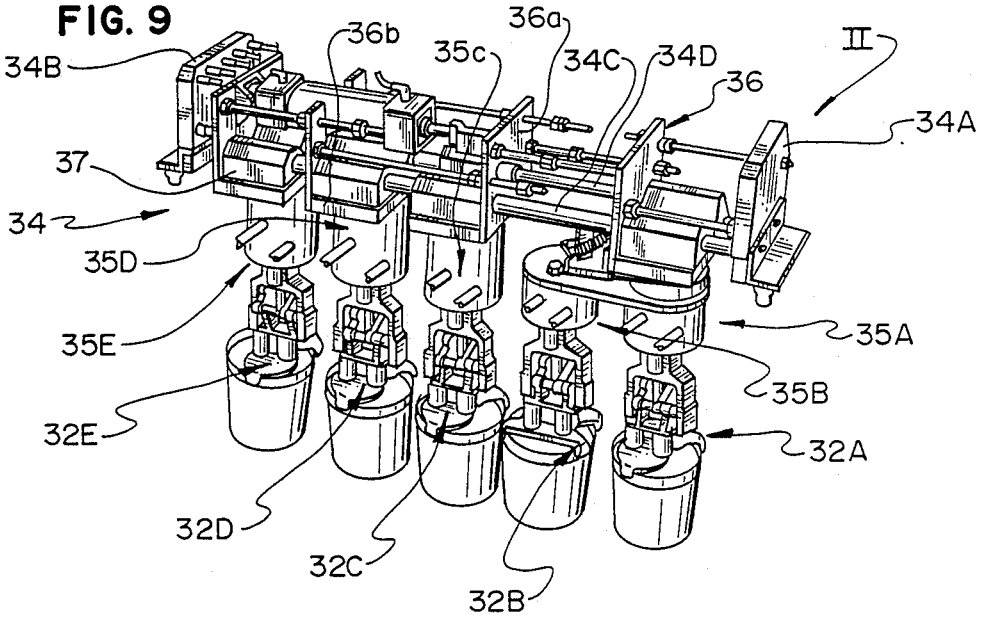
FIG. 9 is a fragmentary, top, perspective view per se of one set of gripper members and associated mechanism removed from the apparatus and showing the gripper members engaging a row of articles prior to one of the articles being segregated from the row.
Figure 10:
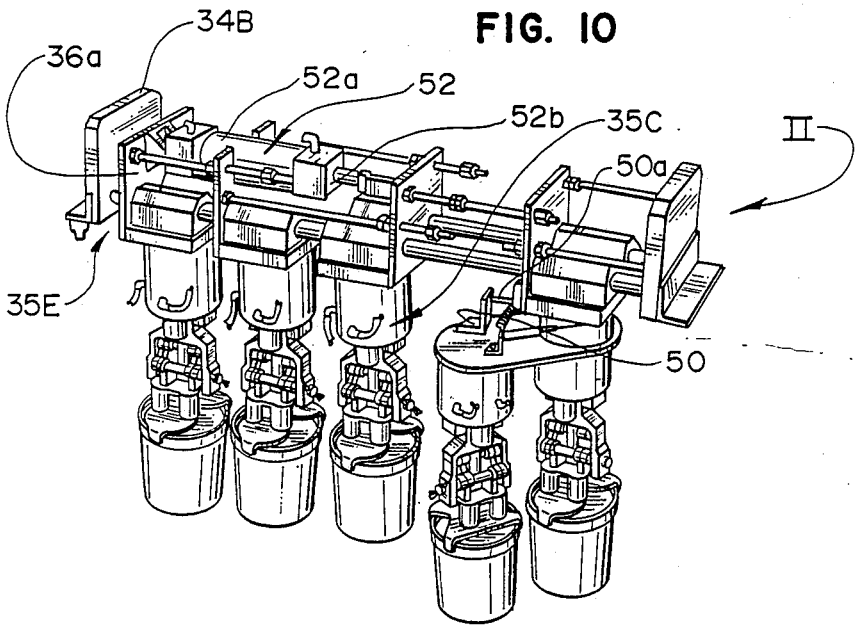
FIG. 10 is similar to FIG. 9 but showing the one article segregated from the other articles in the row and before the said other articles have been readjusted.
Figure 11:
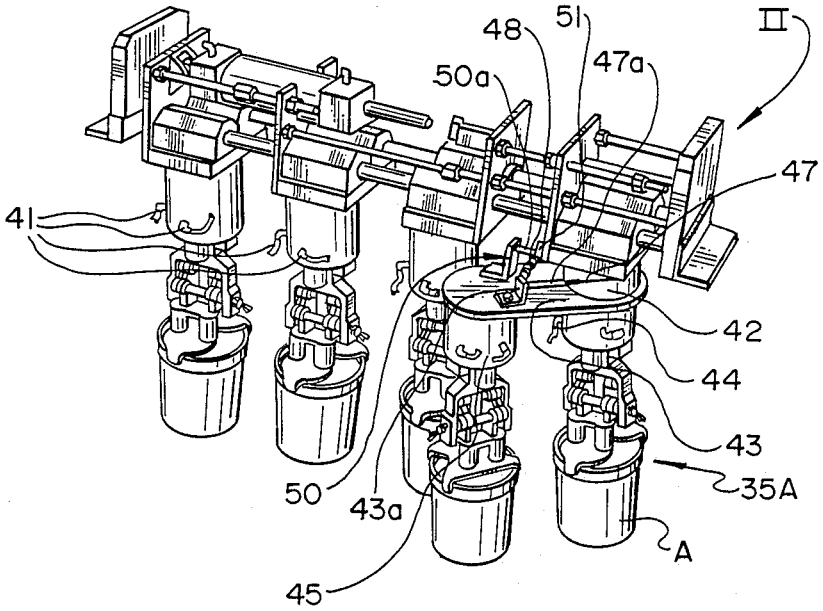
FIG. 11 is similar to FIG. 10 but showing the articles remaining in the row in their readjusted positions.

The gripper members of each set are of like configuration and thus, to facilitate understanding of the structure and operation of the sets of gripper members only set II will be described hereinafter in detail. The gripper members 32A–D as seen in FIGS. 9–11, depend a like amount from a carriage 34 which includes a pair of upright end plates 34A and 34B, maintained in spaced parallel relation by a pair of elongated parallel guide rods 34C, 34D (see FIGS. 9–11) which are connected at opposite ends to the end plates. Located between the end plates 34A, 34B and in supporting engagement with the guide rods 34C, 34D are hanger assemblies 35A–D. Each of the hanger assemblies, except hanger assembly 35D, in set I (FIG. 12) and hanger assembly 35A in set II (FIG. 11) accommodates a single gripper member 32A, 32B. Hanger assembly 35A, as seen in FIG. 9, accommodates a pair of gripper members 32A, 32B as will be discussed more fully hereinafter. Hanger assemblies 35C–E in set II and 35A–C in set I are of similar construction and each includes an L-shaped bracket 36 having one leg 36*a* thereof extending upwardly and provided with openings through which the guide rods 34C, 34D extend. The second leg 36b of bracket 36 is disposed beneath the guide rods 34C, 34D, see FIGS. 12–13. Secured to the upper surface of each bracket leg 36b are sleeves 37 which are adapted to slidably engage the guide rods and thus, maintain the legs 36b in a plane which is parallel to the axis of the guide rods.

Figure 7:
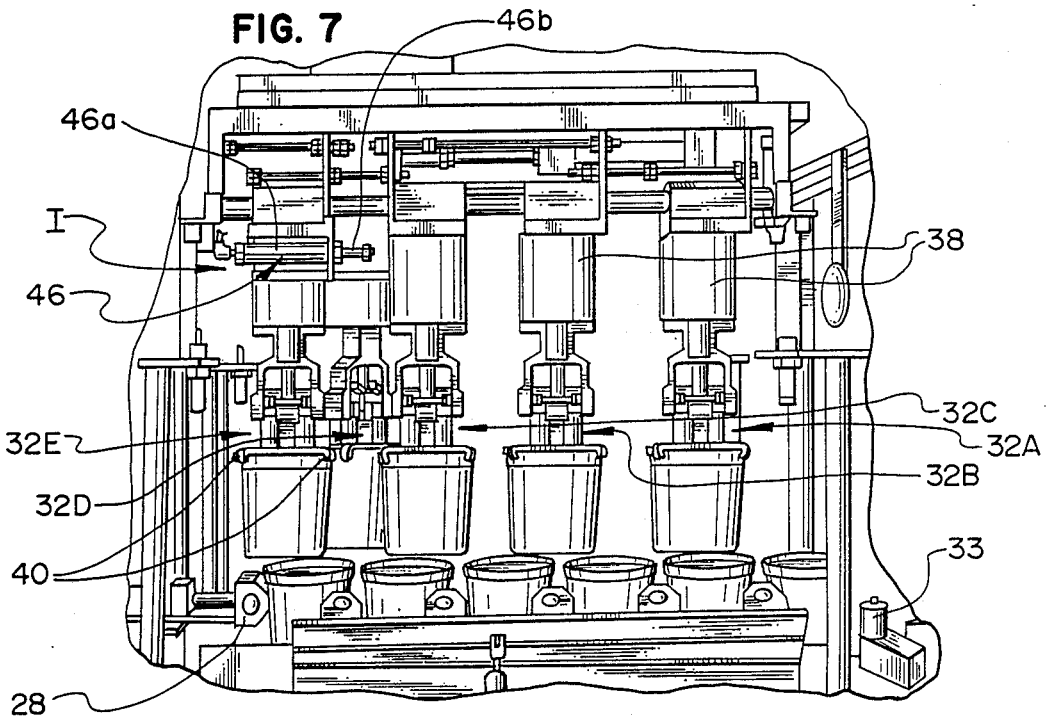
FIG. 7 is an enlarged, fragmentary, left side view of the apparatus showing a selected one of the articles in the raised row segregated from the remaining articles forming the row and with a new row of articles formed at the staging area beneath the raised articles.

In the carriage 34 for set I of gripper members, the hanger assembly 35E is disposed proximate the stop block 28 (see FIG. 7). The carriage for the second set II of gripper members (see FIGS. 9–11) is such that the pattern of containers in one of the abutting cases B disposed at the second station KK will be the same as that in the other abutting case, see FIG. 15. In the second set II of gripper members, the hanger assembly 35A for the pair of gripper members is proximate the gate piece 33.

Attached to the underside of the bracket second legs 36b of hanger assemblies 35A, B, C and E Set I and assemblies 35A, C, D and E in Set II are casings 38 each functioning as a spacer and mounting member for a pneumatically actuated control, not shown, which adjusts between gripping and release positions the jaws 40 of the gripper member connected to the hanger assembly. Suitable air lines 41 are provided for each casing.

Figure 8:
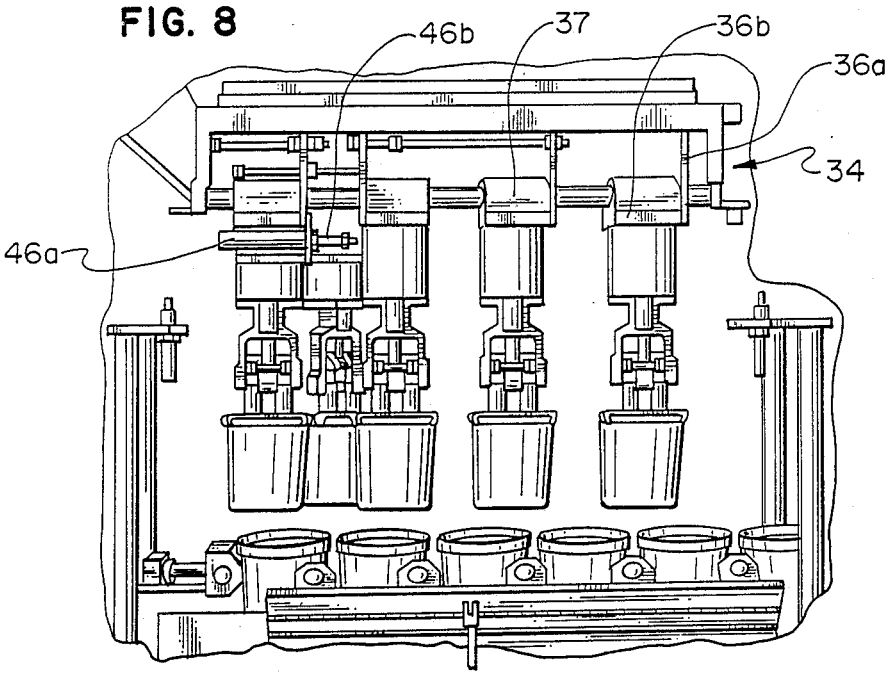
FIG. 8 is similar to FIG. 7 but showing the raised row of articles moved from the preliminary station towards the first station wherein the articles cooperate with the articles from the other preliminary station to form a predetermined pattern before being lowered as a unit into cases disposed at the second station, the latter not being shown.

Mounted on the underside of the bracket leg 36b of hanger assembly 35D of set I and hanger assembly 35A of set II is a reel 42 having a laterally extending plate 43 disposed on the underside thereof, see FIGS. 9–11. Aligned with the reel and disposed beneath plate 43 is a casing 44 in which is accommodated a pneumatically actuated control, not shown for gripper member 32E or 32A. A second casing 45 is affixed to the underside of plate 43 and is laterally offset with respect to casing 44. The plate 43 is rotatable about a vertical axis X—X centrally disposed with respect to casing 44, see FIG. 12. Rotation of the plate 43 and casing 45 about axis X—X is accomplished by a pneumatically actuated piston assembly 46, see FIG. 7. The cylinder 46a of assembly 46 is offset outwardly from reel 42 and is secured to the bracket leg 36a of the hanger assembly 35D. The exposed end 46b of the piston, see FIG. 8 is connected to one end of a wire cable 47, see FIG. 11. The cable passes around the exterior of reel 42 and the opposite end 47a of the cable is connected to an upwardly extending leg 43a formed on plate 43, see FIG. 11. Thus, as the piston is moved to an extended position, the cable 47 will exert a pulling force on leg 43a causing the plate 43 to pivot in a counter-clockwise direction about axis X—X. When the piston moves from an extended position to retracted position, the cable tension is relaxed and the plate 43 pivots in a clockwise direction due to the force of a spring 48, one end of which is connected to the plate leg 43a and the other end connected to a lug, not shown, formed on bracket leg 36a. When the piston is fully retracted, gripper member 32D is in row alignment with the other gripper members comprising the set. The hanger assembly 35A of set II is constructed in the same way and operates the same as the hanger assembly 35D of set I.

As seen in FIGS. 9–11, a bracket 50 is affixed to the upper surface of plate 43 and has transversely mounted thereon a longitudinally adjustable pin 50a. The free end of the pin is adapted to engage a pad 51 formed on the bracket leg 36a of the hanger assembly 35A. By reason of the adjustable pin 50a, the spotting of the segregated container A relative to the case B disposed at the second station KK can be readily accomplished.

Readjustment of the raised containers in a row, subsequent to one of the containers being segregated from the row, is accomplished by a pneumatic piston-cylinder assembly 52 which is mounted within the carriage 34 for each set of gripper members. As seen in FIGS. 10 and 11, the cylinder 52a of assembly 52 of set II is affixed to the bracket leg 36a of the hanger assembly 35E, the latter in turn assuming a fixed position with respect to end plate 34B. The cylinder 52a also extends through a suitable slot T formed in the bracket leg 36a of assembly 35D, see FIG. 9. The exposed end 52b of the piston of assembly 52 is adjustably connected to the bracket leg 36a of hanger assembly 35C. When the piston is in its fully retracted position, see FIG. 5, all of the gripper members of a set are uniformly spaced within a row, so that the gripper members will be aligned with corresponding containers disposed at the staging area SA or SAA, subsequent to the gauge unit upper section 30b having been moved to the operative mode, see FIG. 5.

When the piston of assembly 52 is in its fully extended position, see FIGS. 7 and 11, which occurs subsequent to gripper member 35D of set I or gripper member 35A of set II having moved its engaged container A to a segregated position, the remaining gripper members of the set are automatically adjusted relative to the endmost gripper members 35A and 35E so that the predetermined pattern of the containers will be formed by the sets of gripper members prior to the containers being lowered from the first station K into the cases at the second station KK.

Figure 12:
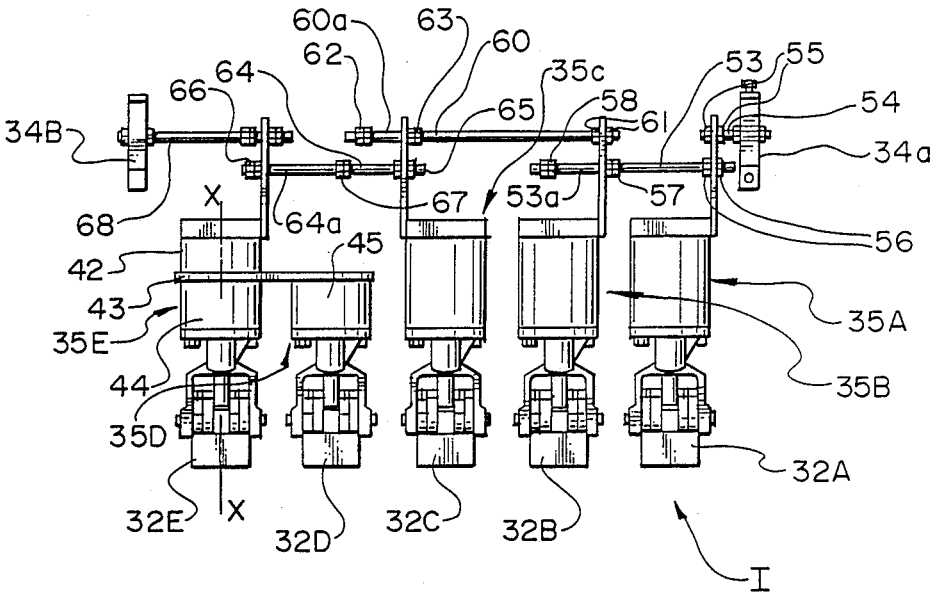
FIG. 12 is a fragmentary side elevational view of the gripper members without the articles, and associated mechanism shown in FIG. 6.

As noted in FIG. 12, the bracket leg 36a of hanger assembly 35A of set I has affixed thereto an elongated differential rod 53 which extends transversely towards and through the bracket leg 36a of hanger assembly 35B. Also mounted on the bracket leg 36a of hanger assembly 35A and extending in the opposite direction from rod 53 is a tie rod 54. Both rods 53 and 54 are externally threaded so that each can be longitudinally adjusted independently of the other by pairs of nuts 55, 56. Nuts 55 are threaded onto rod 54 and tightened against opposite sides of bracket leg 36a of the hanger assembly 35A. Nuts 56 in turn are threaded onto rod 53 and tightened against opposite sides of the same bracket leg 36a.

The bracket leg 36a of hanger assembly 35B of set I is provided with a transverse opening through which a portion 53a of rod 53 slidably extends. Rod 53 has threaded thereon two additional sets of nuts 57, 58. Nuts 57 are located at a predetermined distance from the free end of the rod at which nuts 58 are located. Nuts 57 are disposed between the bracket legs 36a of hanger assemblies 35A and 35B. Nuts 58 in turn are located between the bracket legs 36a of hanger assemblies 35B and 35C.

Mounted on the bracket leg 36a of hanger assembly 35B and extending transversely therefrom towards the bracket leg of hanger assembly 35C is a differential rod 60. One end of rod 60 is affixed to the bracket leg of hanger assembly 35B by a pair of nuts 61 which are threaded onto rod 60 and tightened against opposite sides of the bracket leg 36a of assembly 35B. Threaded onto the opposite end of rod 60 is a set of nuts 62. Intermediate the nuts 61 and 62 is a set of nuts 63 threaded onto rod 60 and located between the bracket legs 36a of hanger assemblies 35B and 35C. The portion 60a of rod 60 between nuts 62 and 63 is slidably disposed within an opening formed in bracket leg 36a of hanger assembly 35C. As aforementioned, the exposed piston end 52b of the piston-cylinder assembly 52 is connected to the bracket leg 36*a* of hanger assembly 35C.

Fixedly mounted on the bracket leg 36*a* of hanger assembly 35C and extending transversely therefrom towards the bracket leg 36*a* of hanger assembly 35E is an elongated differential rod 64. One end of rod 64 is secured to the bracket leg of assembly 35C by a pair of nuts 65 threaded onto rod 64 and tightened against opposite sides of the said bracket leg. A set of nuts 66 are threaded on the opposite end of rod 64 and intermediate the nuts 65 and 66 is a set of nuts 67 threaded onto rod 64. Nuts 66 are located between end plate 34B and the bracket leg 36*a* of hanger assembly 35E and nuts 67 are located between the bracket legs of hanger assemblies 35C, 35E. The portion 64*a* of rod 64 between nuts 66 and 67 is slidably disposed within an opening formed in the bracket leg 36*a* hanger assembly 35E. The bracket 36*a* hanger assembly 35E is retained in a fixed position relative to end plate 34B by a tie rod 68, see FIGS. 12 and 13.

The lengths of rod portions 53*a*, 60*a* and 64*a* may be varied by adjusting nuts 57, 63 and 67, respectively, along the corresponding rods so that the sequence and amount of movement of the hanger assemblies 35B, 35C can be carefully controlled as the piston of the piston-cylinder assembly 52 is moved from its retracted position to its extended position.

Figure 13:
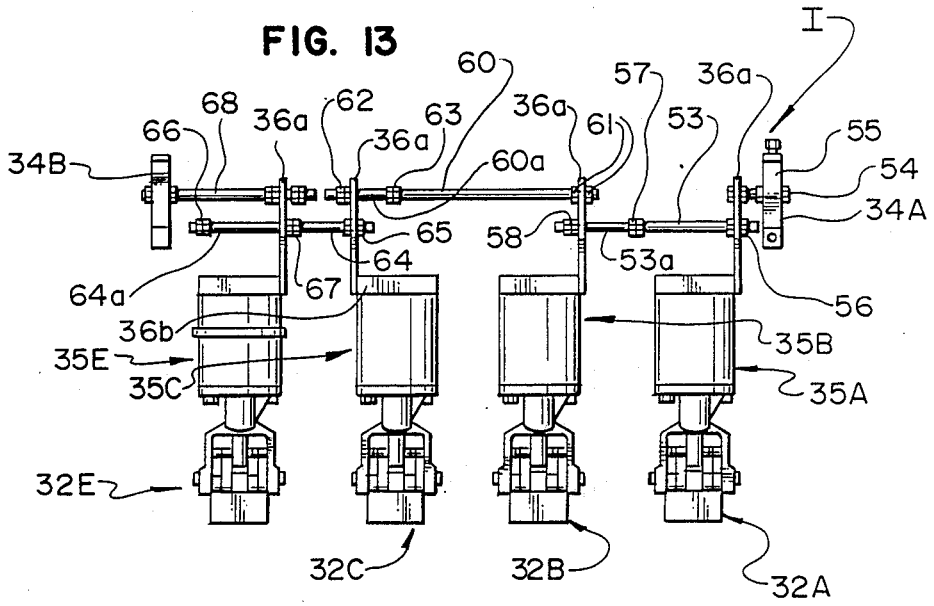
FIG. 13 is similar to FIG. 12 but, except for the segregated gripper member, showing the remaining gripper members readjusted in a row.

The arrangement of the various rods, brackets, and piston assemblies is substantially the same for both sets I and II of gripper members; except in set I, the piston assembly 52 is secured to the end plate 34A and the piston assembly 46 is secured to the bracket leg 36*a* of hanger assembly 35E; and in set II, the piston assemblies 52 and 46 are connected, respectively to the end plate 34B and the bracket leg of hanger assembly 35A.

Where two crates B located at the second station KK are to be simultaneously loaded with the containers A disposed at the first station K the spacing between the containers gripped by gripper members 32B and 32C may be different than that between gripper members 32A and 32B, and 32C and 32E, see FIG. 13 so as to accommodate the thickness of the abutting walls W of the two crates, see FIGS. 14 and 15.

As aforementioned, once the gripped containers of each set have been raised to a preliminary station located above the staging area SA or SAA and one of the gripped containers has been segregated for each row, the carriages 34 for the sets of gripper members I and II are moved from the preliminary stations towards one another until the carriages are disposed at the first station K. To understand how each carriage is moved to the first station reference is made to FIG. 16.

The carriages are supported at opposite ends by a pair of horizontally extending spaced parallel rods 70, only one of said rods being shown in FIG. 16. The ends of the rods are supported by brackets 71, which, in turn, are mounted on a pair of spaced, parallel, horizontally extending support beams 72, only one being shown in FIG. 16. Affixed to each beam is a pair of longitudinally spaced, vertically extending guide members 73. Each guide member is adapted to slidably accommodate a vertically extending stationary post 74, the latter being affixed to the frame 21.

Each carriage 34 of gripper heads includes a housing 75, see FIG. 2, which encloses the various rods 53, 60, 64 and 68; piston/cylinder assembly 52; hanger assemblies 36 and brackets 34A and 34B. The housing 75 has a removable side panel which allows access to service and adjust the mechanism, above described, enclosed within the housing. The housing includes a reinforced top panel which is connected to a cross channel member 76, see FIG. 16. The opposite ends of each member 76 has affixed to the underside thereof a transverse slide plate 77. When the carriage 34 is in an aligned position above the staging area SA or SAA, the slide plate 77 is in substantially superimposed relation with the corresponding bracket 71. The relative size of the underside of slide plate 77 and the upper side of bracket 71 is such that the two surfaces will remain in sliding contact as the carriage moves horizontally to and from the first station along rods 70, as will be described more fully hereinafter.

As seen in FIG. 16, at opposite ends of one support beam 72 there is affixed an upright anchor plate 78. In a similar manner there is affixed to corresponding one ends of channel members 76 upright plates 80. Anchor plates 78 and plates 80 are disposed in spaced parallel relation. Movement to and from the first station K of each carriage is effected by a pair of pneumatically actuated piston cylinder assemblies 81 and 82. Assembly 81 actuates the channel member 76 connected to the carriage set II gripper members and assembly 82 actuates the channel member 76 connected to the carriage of set I gripper members. Both assemblies 81,82 are connected in a similar manner to the respective channel member and thus only assembly 81 will be described in detail hereinafter.

The cylinder 81*a* of assembly 81 is disposed horizontally and in spaced parallel relation to the support rod 70 located therebeneath. One end of cylinder 81*a* is provided with a connecting bracket 81*b* to which is attached a longitudinally extending, connecting rod 81*c*. The outer, or distal, end of rod 81*c* is adjustably connected to an adjacent anchor plate 78. The exposed end of the piston 81*d* is provided with a connector piece 81*e*. Attached to piece 81*e* and extending axially therefrom is a connecting arm 81*f*. The outer end of arm 81*f* is adjustably connected to the upright plate 80 affixed to channel member 76. Suitable air lines or hoses, not shown, are provided for each piston/cylinder assembly 81,82. Thus, as the piston is retracted relative to the cylinder, the channel member 76 connected thereto and the associated carriage will be pulled towards the first station. On the other hand, when the piston is in its fully extended position, as shown in FIG. 16, the channel member 76 and associated carriage are vertically aligned with respect to the staging area SA or SAA.

As seen in FIG. 16, each channel member 76 is provided with laterally spaced, upright bearings 83. Each bearing 83 is adapted to slidably accommodate an elongate, upright guide rod 84. Each rod 84 is affixed to the top of the carriage housing 75 and the rods are parallel to one another. Mounted midlength on each channel member 76 and extending vertically therefrom is a pneumatically actuated elevator piston/cylinder assembly 85.

When the channel member 76 and associated carriages are at the first station K, the elevator piston/cylinder assemblies 85 work in unison to effect vertical movement of the members and associated carriages towards and away from the crates B located at the second station KK. Also mounted on each channel member 76 and adjacent one of the guide rods 84 is an upright switch tower 86. Mounted on the tower at a predetermined elevation is a first switch, such as a reed switch, not shown, which stops the upward movement (retraction) of the piston of assembly 85. A second switch, not shown, may also be mounted on tower 86 at a predetermined distance beneath the first switch. The second switch stops the downward (extended) movement of the piston of assembly 85. The switches are triggered by a trip collar 87 carried on the upper end of the adjacent guide rod 84.

In lieu of the switches, photoelectric cells, not shown, may be utilized wherein the light beams emitted from the cells are interrupted when the channel member 76 and associated carriage reach their up and down positions with respect to the crates B at the second station KK.

When the carriages 34 are at their lowermost position with respect to the crates B, the gripper members of each carriage automatically move downwardly as a unit independently of the carriage and deposit (release) the gripped containers A, while in the predetermined pattern, into the respective crates B.

The sequence of movement of the gripper members and the carriages are controlled through suitable switches, relays, etc. which are sequentially controlled through suitable computer software incorporated in the control panel P mounted on the frame 21, see FIG 1A.

In order to accommodate containers which may vary in height, an elevating mechanism 88, see FIG. 16, is provided for selectively adjusting the elevation of the channel members 76, associated carriages 34, rods 70 and piston/cylinder assemblies 81 and 82 with respect to a horizontal plane which includes the staging areas SA and SAA. Mechanism 88 includes four jack screws 90, 91, 92 and 93. Each jack screw is disposed adjacent an end of the channel member 76 and is associated with a corresponding guide member 73. Each member 73 has a laterally extending flange *73a* which is provided with a suitable opening *73b* through which the shank of the jack screw extends. The opening *73b* may be internally threaded or a nut N, as shown, may be affixed to the underside of flange *73a* and in alignment with the opening *73b*. Keyed to the upper end of the shank of each jack screw is a sprocket wheel 94. All of the sprocket wheels are interconnected by an endless chain 95. The chain also engages and is driven by a drive sprocket 96, which in the illustrated embodiment is located between jack screws 91 and 92. The location of the drive sprocket 96 may vary from that shown, if desired. Chain tension wheels 97 may be disposed on opposite sides of the drive sprocket. The drive sprocket 96 is operatively connected to a reversible drive motor, not shown, which is mounted on the frame. Depending upon the direction of rotation of the drive sprocket, the chain 95 will rotate in unison all of the jack screw sprockets 94 the same amount in the same direction, thereby causing the beams 72, rods 70, channel members 76 and piston/-cylinder assemblies 81 and 82 to move as a unit towards or away from the staging areas. Such unitary movement allows the gripper members of each set I and II to accommodate articles A the height of which may vary.

Depending upon the height of the articles being cased, it is normal that each crate B contains at least two layers of articles. Suitable sensors, not shown, may be utilized in combination with the controls which regulate the down-stroke of the piston of the piston/cylinder assembly 85 for each carriage of the set I,II of gripper members. The use of such sensors to control the movement of such a mechanical element is well known in the caser art.

Once the crates B have been fully loaded, the conveyor 25 is activated causing the loaded crates to pass through the discharge side D of the apparatus. Simultaneously with the movement of the loaded crates, empty crates are moved to station KK.

When the safety panels Y are in place, personnel are protected from the moving carriages 34, gripper members, gauge units 30, stop blocks 28 and gate pieces 33. When the apparatus is shut down for servicing and maintenance, the safety panels may be readily removed, thereby facilitating access to various components. Removal of the carriage housing side panel after one safety panel has been removed, exposes the various components enclosed within the housing, see FIGS. 4–8, thereby enabling the relative positions of the individual gripper members to be adjusted to accommodate a variety of articles disposed at a staging area.

While the apparatus, as illustrated, effects simultaneous loading of two square-shaped crates with five pre-patterned containers in each crate, the improved apparatus, as herein claimed, is not intended to be limited thereto. The size and number of crates to be loaded and the number of containers to be simultaneously deposited in a crate may vary over a wide range and will depend upon the capacity of the packing line in which the apparatus is disposed.

Thus, an improved apparatus has been provided which expeditiously and simultaneously deposits a plurality of containers (articles), the shape and size of which varies over a wide range into a predetermined number of crates or cases. The apparatus is fully automatic thereby reducing the number of personnel required to operate the packing line.

I claim:

1. An apparatus for loading a plurality of articles arranged in a predetermined pattern into at least one open top receptacle, said apparatus comprising a frame having a first station wherein the plurality of articles are assembled in the predetermined pattern, and a second station spaced from said first station wherein at least one receptacle is positioned; first conveyor means for moving the articles to a pair of staging areas disposed on opposite sides of said first station, the articles being arranged in a row when disposed at each staging area; a second conveyor means for successively moving open top receptacles to said second station and then subsequently moving same when loaded away from the second station; a set of article-engaging means mounted proximate each staging area, each set being sequentially adjustable to effect engagement of the row of articles in the proximate staging area, raising the engaged articles to a preliminary station, laterally offsetting and segregating at least one engaged article from the row and relatively repositioning the remaining engaged articles in the row while the engaged articles are disposed at the preliminary station, and moving the segregated and repositioned articles to the first station whereby the articles engaged by both sets of article-engaging means coact to form the predetermined pattern; means for moving the articles in the predetermined pattern from the first station and depositing same into the open top receptacle at the second station; and means for returning each set of article-engaging means to proximate the respective staging area.

2. The apparatus of claim 1 wherein the first station is elevated relative to the second station.

3. The apparatus of claim 2 wherein the first and second stations are in substantially vertical alignment.

4. The apparatus of claim 1 wherein at least the one selected article in the row of articles at the preliminary station is laterally offset in a direction towards the first station prior to being moved to said first station.

5. The apparatus of claim 1 wherein each staging area is provided with an adjustably mounted spacer means and a gate means, said spacer means being adjustable between operative and inoperative modes; when in an operative mode, said spacer means being disposed between and separating adjoining articles in the row of articles at the staging area and, when in the inoperative mode, being disposed out of the path of the articles when being conveyed by the first conveyor to the staging area; said gate means being adjustable between open and close modes; when in the close mode, said gate means blocking movement of the articles onto the staging area; said spacer means being adjusted to the operative mode only when said gate means is in the close mode.

6. The apparatus of claim 5 wherein each staging area is provided with an adjustable stop spaced a predetermined first distance from the gate means and engaged by an endmost article in a row when the predetermined number of articles have been assembled at the staging area, said stop being adjusted to a predetermined second distance from the gate means when the spacer means is in the operative mode; said second distance being greater than said first distance.

7. The apparatus of claim 1 wherein each article-engaging means includes a plurality of jaws for engaging an upper end portion of an article when the article is being raised to the preliminary station.

8. The apparatus of claim 1 wherein each set of article-engaging means depend from a horizontally disposed carriage, said carriage being in a substantially horizontal plane when the set of article-engaging means is being sequentially adjusted to effect engagement of the row of articles in the proximate staging area and raising of the engaged articles to the preliminary station, said carriage being adjustable in said substantially horizontal plane when the set of article-engaging means is being sequentially adjusted to effect movement of the segregated and repositioned articles from the preliminary station to the first station.

9. The apparatus of claim 8 wherein the carriage includes elongated substantially horizontal support means from which each article-engaging means depends, predetermined article-engaging means being independently adjustable longitudinally of the elongated support means when the engaged articles are disposed at said preliminary station.

10. The apparatus of claim 4 wherein the article-engaging means for the preselected article is mounted on a laterally extending support member pivotal about a substantially vertical axis; said article-engaging means being laterally offset from said pivotal axis.

11. The apparatus of claim 10 wherein the support member is pivotally connected to an article-engaging means of an article adjacent to the preselected article.

12. The apparatus of claim 8 wherein each carriage when sequentially moving from the preliminary station to the first station slidably engages substantially horizontal guide means affixed to a vertically adjustable frame section.

13. The apparatus of claim 12 wherein the frame section is vertically adjustable subsequent to the articles being assembled in the predetermined pattern at the first station and the predetermined number of receptacles being disposed at the second station.

14. The apparatus of claim 1 wherein the sequential adjustment of each set of article-engaging means is regulated by control means mounted on the frame 15. The apparatus of claim 14 wherein the control means includes a computer programming unit.

* * * * *